US006540626B1

(12) United States Patent
Tsai

(10) Patent No.: US 6,540,626 B1
(45) Date of Patent: Apr. 1, 2003

(54) RACKET STRUCTURE WITH BALL-STRIKING RACKET FACE

(76) Inventor: Steven Tsai, No. 30, Lane 98, Yeng-Shing Street, Taichung City (TW)

( * ) Notice: Subject to any disclaimer, the term of this patent is extended or adjusted under 35 U.S.C. 154(b) by 0 days.

(21) Appl. No.: 10/114,477

(22) Filed: Apr. 3, 2002

(51) Int. Cl.[7] ..... A63B 49/00; A63B 51/00
(52) U.S. Cl. ..... 473/540; 473/543; 473/522
(58) Field of Search ..... 473/543, 539, 473/540, 522, 524, 520

(56) References Cited

U.S. PATENT DOCUMENTS

| | | | | | |
|---|---|---|---|---|---|
| 4,750,742 | A | * | 6/1988 | Coupar | 473/540 |
| 4,909,511 | A | * | 3/1990 | DeVille et al. | 473/522 |
| 4,993,711 | A | * | 2/1991 | DeVille et al. | 473/522 |
| 5,702,313 | A | * | 12/1997 | Stennett | 473/546 |
| 5,762,570 | A | * | 6/1998 | Shaw | 473/522 |
| 5,980,403 | A | * | 11/1999 | Simidian, II | 473/553 |

FOREIGN PATENT DOCUMENTS

| | | | | |
|---|---|---|---|---|
| EP | 421950 | * | 4/1991 | A63B/51/06 |
| GB | 2186804 | * | 8/1987 | A63B/49/02 |

* cited by examiner

*Primary Examiner*—Raleigh W. Chiu
(74) *Attorney, Agent, or Firm*—Troxell Law Office PLLC

(57) ABSTRACT

Racket structure with ball-striking racket face, including a racket frame having an inner and an outer frame faces respectively formed on two radially opposite sides of the racket frame. The racket frame is formed with multiple through holes forming openings on the inner and outer frame faces. Multiple hollow stringing pins are respectively coaxially fitted in the corresponding through holes. At least one strip made of resilient material with a predetermined thickness is fixedly attached to the inner frame face. The strip is formed with several perforations having a predetermined diameter and communicating with the holes of the corresponding stringing pins. The diameter of the perforation can be changed within a certain range when suffering an external force. A string having a hardness greater than that of the strip is sequentially conducted through the stringing pins and the perforations of the strip to form a checkered mesh in the racket frame. The diameter of the string is larger than the diameter of the perforation. When conducted through the perforation, the edge of the perforation is pressed by the harder string so that the diameter of the perforation is enlarged and the edge thereof tightly embraces the string.

5 Claims, 3 Drawing Sheets

RACKET STRUCTURE WITH BALL-STRIKING RACKET FACE

BACKGROUND OF THE INVENTION

The present invention is related to a sport implement, and more particularly to an improved racket structure with ball-striking racket face.

There is an existent racket frame structure which is free from any stringing pins. Such racket frame structure includes a racket frame body. The inner circumference of the frame body is formed with an accommodating channel in which a trapezoid resilient member is integrally fixedly accommodated. The frame body is formed with multiple stringing holes passing through the frame body from the inner circumference to outer circumference thereof. A string is sequentially conducted through the stringing holes to form a tensioned mesh-like racket face in the frame body.

The above racket structure has no conventional stringing pin. Therefore, when conducted between the inner and outer circumferences of the frame body, the string is not guided. This leads to inconvenience in stringing operation. Moreover, in order to more easily pass the string through the resilient member, the stringing hole is often designed with a diameter larger than that of the string for facilitating stringing operation. Accordingly, the string only contacts with the resilient member and is not tightly held thereby. When the racket face strikes a ball and suffers an impact, the reaction force transmitted by the string can be hardly effectively absorbed by the resilient member. In other words, the resilient member is unable to achieve optimal buffing effect.

There is another type of racket structure composed of two halves of frame body, which are mated with each other to form the racket frame. A cushion material is sandwiched between the two halves of frame body for absorbing shock. Such structure leads to poor strength of the frame body. Moreover, it is troublesome to process and combine the two halves into the frame body and thus the production efficiency is reduced.

SUMMARY OF THE INVENTION

It is therefore a primary object of the present invention to provide an improved racket structure with ball-striking racket face, which has excellent shock-absorbing and buffing effect.

It is a further object of the present invention to provide the above racket structure with ball-striking racket face, in which the stringing pins are truly located to facilitate stringing operation.

According to the above objects, the racket structure with ball-striking racket face includes: a racket frame including an annular frame body having an inner frame face and an outer frame face respectively formed on two radially opposite sides of the frame body, the frame body being formed with multiple through holes passing through the frame body to form corresponding openings on the inner and outer frame faces; a handle having a predetermined length, one end of the handle being connected with the racket frame; multiple hollow stringing pins respectively coaxially fitted in the corresponding through holes; at least one strip made of resilient material and having a predetermined thickness, one face of the strip being fixedly attached to the inner frame face of the racket frame, the strip being formed with several perforations having a predetermined diameter, the perforations communicating with the holes of the corresponding stringing pins, whereby the diameter of the perforation can be changed within a certain range when suffering an external force; and a string having a hardness greater than that of the strip. The string has a predetermined diameter and is sequentially conducted through the stringing pins and the corresponding perforations of the strip to form a checkered mesh in the racket frame. The diameter of the string is larger than the diameter of the perforation, whereby when the string is conducted through the perforation, the edge of the perforation is pressed by the harder string so as to enlarge the diameter of the perforation and the edge of the perforation tightly embraces the string.

The present invention can be best understood through the following description and accompanying drawings wherein:

DETAILED DESCRIPTION OF THE PREFERRED EMBODIMENTS

Figure 1:
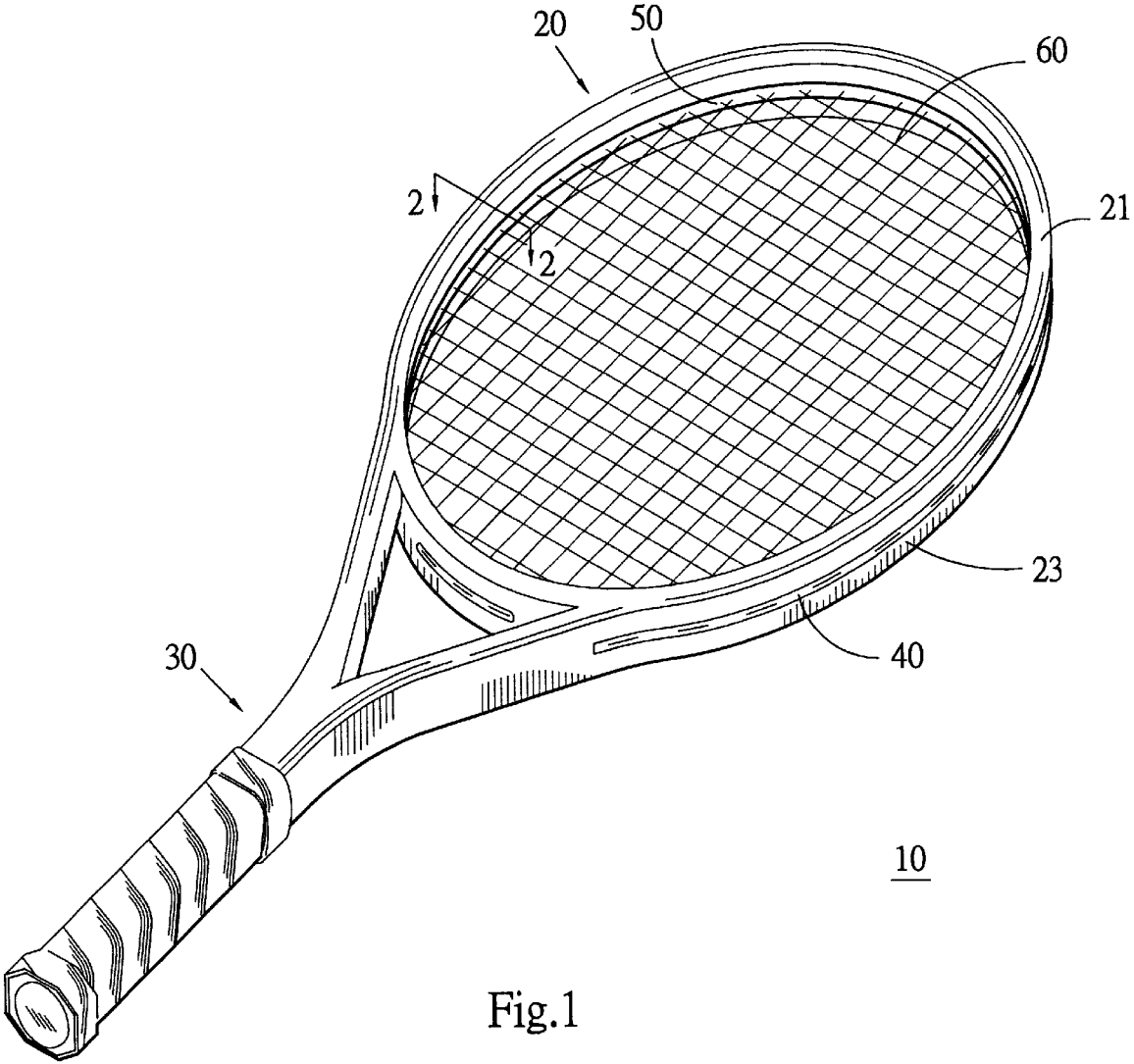
FIG. 1 is a perspective view of a first embodiment of the present invention.
Figure 2:
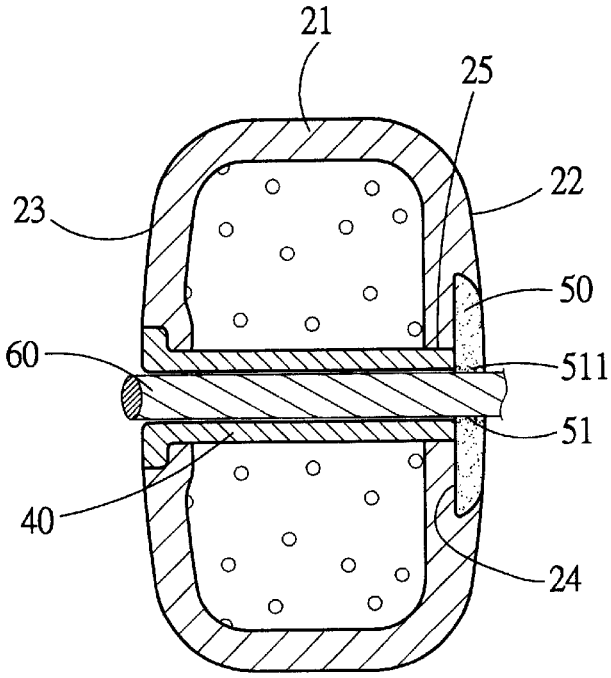
FIG. 2 is a sectional view taken along line 2—2 of FIG. 1.
Figure 3:
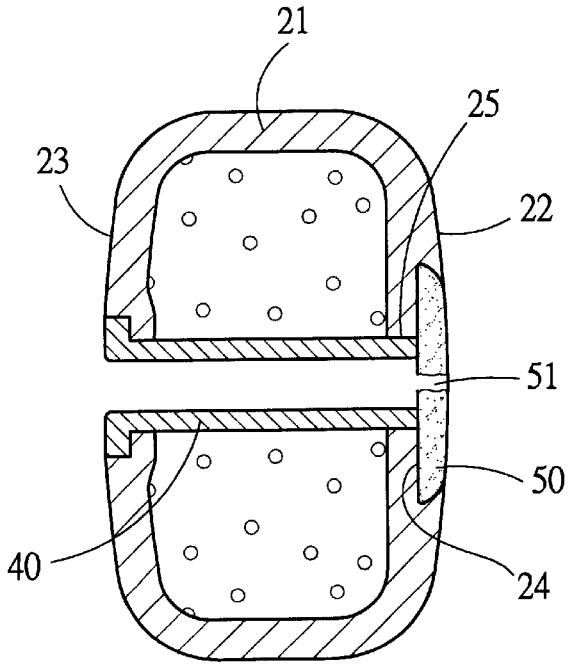
FIG. 3 is a sectional view according to FIG. 2, showing that the string is not yet conducted through the perforation of the strip.

Please refer to FIGS. 1 to 3. According to a first embodiment of the present invention, the racket structure 10 is composed of a racket frame 20, a handle 30, multiple hollow stringing pins 40, a strip 50 with a certain length and a string 60 with a certain hardness.

The racket frame 20 includes an elliptic frame body 21 having an inner frame face 22 and an outer frame face 23 respectively formed on two radially opposite sides of the frame body 21. The inner frame face 22 is formed with an accommodating channel 24 which extends along the circumference of the frame body 21. The frame body 21 is formed with multiple through holes 25 inward extending from the outer frame face 23 to the bottom of the accommodating channel 24.

The handle 30 has a certain length and is integrally connected with the racket frame 20 for a user to hold.

The stringing pins 40 are sequentially upright fixedly arranged on a seat plate. The pins 40 have a certain length and a hollow cross-section. The pins 40 are respectively coaxially fitted in the corresponding through holes 25.

The strip 50 has a length approximately equal to the length of the circumference of the inner frame face. The strip 50 is made of resilient material and has a certain thickness. The strip 50 is fully inlaid in the accommodating channel 24 in flush with the inner frame face of the frame body. The strip 50 is formed with several perforations 51 having a certain diameter. The perforations 51 communicate with the holes of the corresponding pins 40.

The string 60 is conducted through the racket frame 20 to form a tensioned racket face in the frame body 21.

It should be noted that the diameter of the perforation 51 can be changed within a certain range when suffering an external force. The diameter of the string 60 is larger than that of the perforation 51. When the string 60 is conducted through the perforation 51, due to the hardness of the string 60, the edge of the perforation 51 is pressed and displaced so as to enlarge the diameter of the perforation 51. Accordingly, the edge of the perforation 51 tightly embraces the string 60 to integrally connect therewith. Moreover, when the diameter of the perforation 51 is enlarged by the string 60 and the displaced edge 511 of the perforation tightly embraces the string 60, the density of the edge 511 is increased due to compression. Therefore, the density of the edge 511 is slightly greater than the average density of the strip 50.

Furthermore, the edge 511 of the perforation 51 tightly embraces the string 60 to integrally connect therewith. Accordingly, the strip 50 is able to integrally distribute the force applied to the racket face formed of the string 60. In other words, when striking the ball, the impact force applied to the racket face can be properly buffed and compensated by the strip 50. Moreover, the edge 511 of the perforation embracing the string 60 is compressed to increase the density thereof to a certain extent. Therefore, the action force is transmitted from the string 60 through the edge 511 with higher density to the entire strip 50. This increases the shock-absorbing ability of the strip 50 and prolongs using life of the racket.

In addition, it should be noted that by means of changing the diameter of the perforation 51, the tightness between the string 60 and the edge of the perforation 51 can be changed. Further by means of cooperatively setting the elastic coefficient and thickness of the strip 50, different buffing and shock-absorbing effects can be achieved. Accordingly, different requirements of different users can be optimally satisfied.

Figure 4:
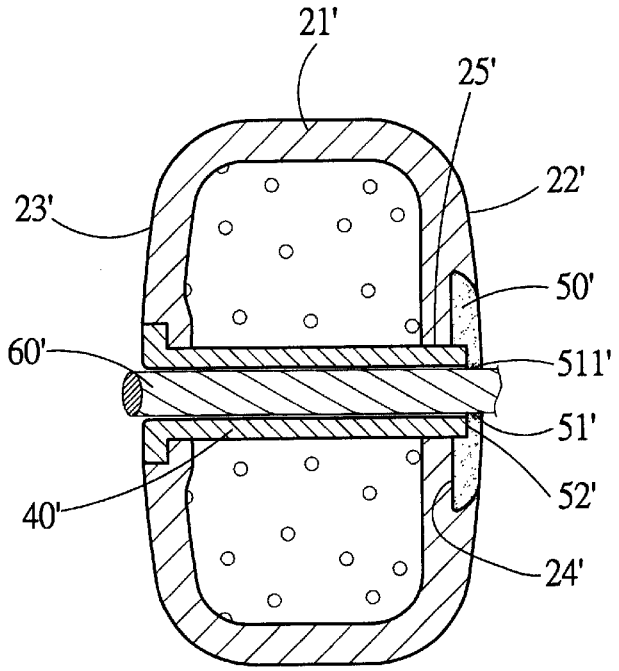
FIG. 4 is a sectional view of a second embodiment of the present invention.

FIG. 4 shows a second embodiment of the present invention, in which the racket structure 10' is basically identical to the first embodiment. The second embodiment is different from the first embodiment in that the strip 50' further has a groove 52' formed on one face of the strip 50' facing the bottom of the accommodating channel 24'. The groove 52' extends along the length of the strip 50', whereby the bottom of the groove 52' and the bottom of the accommodating channel 24' define therebetween a receiving space.

One end of each pin 40' extends out from the opening of the corresponding through hole 25' and is accommodated in the receiving space, whereby the respective pins 40' can be conveniently fitted into the corresponding through holes 25'. Prior to stringing operation, the pins 40' can be preliminarily located to facilitate stringing operation. Accordingly, the string can be truly conducted through the pins 40' without being deflected due to deflection of the pins. The second embodiment can achieve the same function as the first embodiment.

Moreover, by means of the groove 52', the total weight of the strip 50' is reduced so as to decrease the total weight of the racket.

Figure 5:
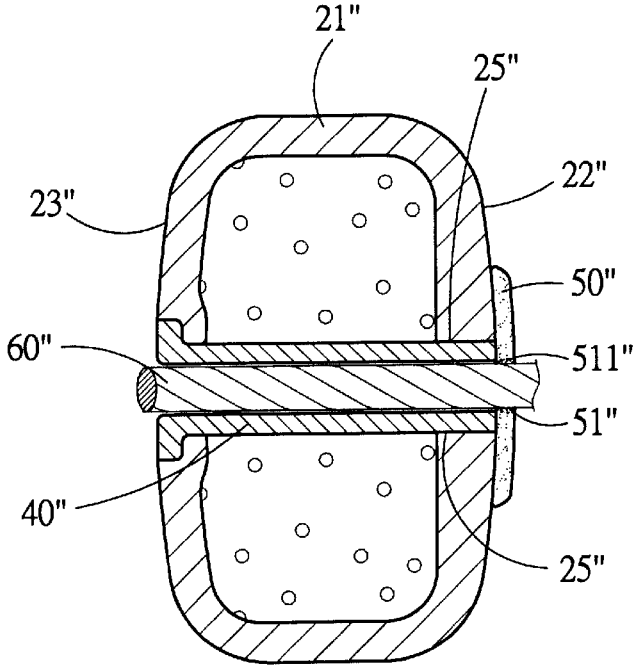
FIG. 5 is a sectional view of a third embodiment of the present invention.

FIG. 5 shows a third embodiment of the present invention, in which the perforation 51" of the racket structure 10" has a diameter smaller than that of the string 60" as in the first embodiment. The third embodiment is different from the first embodiment in that the inner frame face 22" is a smooth arch face free from the accommodating channel of the first embodiment. The strip 50" is directly fixedly adhered to the inner frame face 22". Such structure can achieve a buffing effect the same as the first embodiment. In practice, a user can additionally adhere the strip 50" onto a conventional racket. Depending on whether the pins 40" protrude from the inner frame face 22", strips with different cross-sectional shapes can be selected and partially or entirely attached to the inner frame face 22" to enhance the shock-absorbing effect of the conventional racket. The number and position of the strip 50" are not limited and are variable with the actual requirement. Therefore, the present invention can be widely applied to various rackets.

The above embodiments are only used to illustrate the present invention, not intended to limit the scope thereof. Many modifications of the above embodiments can be made without departing from the spirit of the present invention.

What is claimed is:

1. Racket structure with ball-striking racket face, comprising:

a racket frame including an annular frame body having an inner frame face and an outer frame face respectively formed on two radially opposite sides of the frame body, the frame body being formed with multiple through holes passing through the frame body to form corresponding openings on the inner and outer frame faces;

a handle having a predetermined length, one end of the handle being connected with the racket frame;

multiple hollow stringing pins respectively coaxially fitted in the corresponding through holes;

at least one strip made of resilient material and having a predetermined thickness, one face of the strip being fixedly attached to the inner frame face of the racket frame, the strip being formed with several perforations having a predetermined diameter, the perforations communicating with the holes of the corresponding stringing pins, whereby the diameter of the perforation can be changed within a certain range when suffering an external force; and a string having a hardness greater than that of the strip, the string having a predetermined diameter, the string being sequentially conducted through the stringing pins and the corresponding perforations of the strip to form a checkered mesh in the racket frame, the diameter of the string being larger than the diameter of the perforation, whereby when the string is conducted through the perforation, the edge of the perforation is pressed by the harder string so as to enlarge the diameter of the perforation and the edge of the perforation tightly embraces the string.

2. Racket structure with ball-striking racket face as claimed in claim 1, wherein the end of each stringing pin proximal to the inner frame face is not protruded from the inner frame face.

3. Racket structure with ball-striking racket face as claimed in claim 1, wherein the inner frame face of the racket frame is formed with at least one accommodating channel in which the strip is inlaid.

4. Racket structure with ball-striking racket face as claimed in claim 3, wherein the strip has a groove formed on one face of the strip facing the bottom of the accommodating channel, whereby the bottom of the groove and the bottom of the accommodating channel define therebetween a receiving space in which one end of the stringing pin is accommodated.

5. Racket structure with ball-striking racket face as claimed in claim 1, wherein the edge of the perforation embracing the string is compressed to enlarge the diameter of the perforation and increase the density of the edge of the perforation, whereby the density of the edge of the perforation is slightly greater than the average density of the strip.

* * * * *